US006013117A

United States Patent [19]

Ederyd

[11] Patent Number: 6,013,117

[45] Date of Patent: Jan. 11, 2000

[54] PCD OR PCBN TOOLS FOR THE WOOD INDUSTRY

[75] Inventor: Stefan Ederyd, Saltsjö-Boo, Sweden

[73] Assignee: Sandvik AB, Sandviken, Sweden

[21] Appl. No.: 08/836,573

[22] PCT Filed: Nov. 17, 1995

[86] PCT No.: PCT/SE95/01366

§ 371 Date: Jun. 30, 1997

§ 102(e) Date: Jun. 30, 1997

[87] PCT Pub. No.: WO96/16194

PCT Pub. Date: May 30, 1996

[30] Foreign Application Priority Data

Nov. 18, 1994 [SE] Sweden ..... 9404019

[51] Int. Cl.[7] ..... B24D 3/00; B24D 3/04; C22C 26/00; C22C 29/16

[52] U.S. Cl. ..... 51/309; 51/307; 428/323

[58] Field of Search ..... 51/295, 309, 307; 428/323

[56] References Cited

U.S. PATENT DOCUMENTS 3,743,489 7/1973 Wentorf, Jr. et al. ..... 51/309
4,063,909 12/1977 Mitchell ..... 51/309
5,371,975 12/1994 Lundmark .

FOREIGN PATENT DOCUMENTS

94/02297 2/1994 WIPO .

OTHER PUBLICATIONS

Patent Abstracts of Japan, vol. 13, No. 190, C–593, abstract of JP,A, 1–15343 (Sumitomo Electric Ind Ltd) Jan. 19, 1989.

Dialog Information Services, File 351, World Patent Index 81–96, Dialog accession No. 003457893, WPI accession No. 82–08727E/05, Sumitomo Elec Ind KK: "Hard sintered material, esp. for cutting tool mfr. comprising diamond particles and nickel–chromium–carbon ally, opt. with chromium carbide"; & JP,A,56164073, 8205 (Basic) Dec. 1981.

Patent Abstracts of Japan, vol. 11, No. 229, C–436, abstract of JP,A, 62–40340 (Mitsubishi Metal Corp), Feb. 21, 1987.

*Primary Examiner*—Michael Marcheschi
*Attorney, Agent, or Firm*—Burns, Doane, Swecker & Mathis, L.L.P.

[57] ABSTRACT

There is disclosed PCD or PcBN-tools for cutting wood containing 3 to 20 volume % binder phase based in Ni and/or Co. The binder phase comprises in solution, in weight percent, Co max 95, Ni max 95, Cr 5–45. In addition, nitrides and/or carbonitrides of Zr, Ti, Cr, Ta and/or V are evenly distributed in the structure in an amount of less than 50 volume %, preferably 5 to 40%, of the binder phase with a mean grain size less that 5 $\mu$m, preferably 0.3 to 4 $\mu$m.

13 Claims, No Drawings

PCD OR PCBN TOOLS FOR THE WOOD INDUSTRY

BACKGROUND OF THE INVENTION

The present invention relates to new PCD (polycrystalline diamond) or PcBN (polycrystalline cubic boron nitride) tools with excellent properties in tools for the wood industry. More particularly, the invention relates to PCD or PcBN in which a corrosion and oxidation resistant phase has been distributed in the skeleton of diamonds or cBN-particles characterized by extensive bonding between the hard particles. This corrosion and oxidation resistant phase is based on cobalt and/or nickel chrome.

Reconstituted wood products, such as medium density fiber board and chip board, are, together with solid wood, the main raw materials in the furniture industry. They are also used in the housing industry to some extent.

These products are machined with a variety of tool materials, from high speed steel to cemented carbide to polycrystalline diamond. A leading role is being played by tools made with cemented carbide and PCD or PcBN-tools.

The composition of PCD or PcBN used for woodworking tools consist generally of diamonds or cBN with cobalt as an intergranular phase. Sometimes small amounts of other carbides, nitrides or carbonitrides are added.

The constitution of the PCD are built up by one or several layers/translayers with different compositions regarding diamond contents and cobalt.

Abrasion has been thought to be the primary mechanism of tool wear when machining reconstituted wood products and solid wood. Recent work has proven that chemical mechanisms such as corrosion and oxidation play a significant role in the degradation of cutting edges, as the temperature increases dramatically during the machining process.

The chemical degradation of existing PCD and PcBN-tools is at least a two stage process when machining wood products.

At first, the degradation occurs at a low temperature (300–500° C.), in the early period of cutting. As the tool temperature rises, the wood products decompose and numerous chemicals are introduced in the cutting environment. More than 200 different compounds have been identified upon the destructive distillation of wood. The machining of medium density fiber board and particle board produces even more decomposition products. These products contain also a binder such as urea, formaldehyde, wax and glue fillers and extenders and possibly chemicals added as flame retardants. The decomposition products formed are highly corrosive and attack the cobalt-phase that fills the voids between the hard particles. When this occurs, the diamond-grains loses the sites of the diamond-diamond contact due to the high mechanical stresses and the cutting edge loses its sharpness and its cutting capability.

As the temperature rises above 500° C., the decomposition products are violatised and removed, but degradation of the cutting edge continues by oxidation of the cobalt phase in air. The oxides formed are readily removed by mechanical action, resulting in a fast degradation of the sharpness of the cutting edge.

OBJECTS AND SUMMARY OF THE INVENTION

It is an object of this invention to avoid or alleviate the problems of the prior art.

It is further an object of this invention to provide PCD or PcBN tools with excellent properties in tools for the wood industry.

It is an aspect of the invention to provide a tool for cutting wood comprising polycrystalline diamond or polycrystalline boron nitride in 3 to 20 vol-% binder phase based on Ni and/or Co wherein said binder phase comprises in solution, in weight-%, Co max 95, Ni max 95, Cr 5–45 and additives of nitrides and/or carbonitrides of Zr, Ti, Cr, Ta and/or V in an amount of less than 50 volume-% of the binder phase with a mean grain size less than 5 $\mu$m with an even distribution in the structure.

DETAILED DESCRIPTION OF THE PREFERRED EMBODIMENTS OF THE INVENTION

The present invention relates to new types of PCD with excellent corrosion and oxidation resistance properties particularly satisfying the different needs of the wood industry.

Resistance to corrosion and oxidation has been achieved by alloying cobalt and/or nickel with chrome and distributing it in the PCD-skeleton.

The material according to the invention comprises 3 to 20 vol-% of Co and/or Ni with additives of nitrides and/or carbonitrides of Zr, Ti, Cr, Ta and/or V. The amount of said additives should be less than 50 volume-%, preferably 5 to 40% of the binder phase. The mean grain size shall be less than 5 $\mu$m, preferably 0.3 to 4 $\mu$m with an even distribution in the structure.

In one embodiment when sharp edges are required, e.g., for finishing of hard wood as hickory or teak for fine surface smoothness, the mean grain size of said diamonds is <5 $\mu$m, preferably <2 $\mu$m, most preferably <1.5 $\mu$m. The content of the binder shall be 5 to 20 volume-%, preferably 6 to 11 volume-%.

In an alternative embodiment when the wear properties should be optimized, e.g., for machining medium density fiber board and chip board the mean grain size of said diamonds should be between 5 and 20 $\mu$m, preferably 5 and 8 $\mu$m. The content of the binder shall be 3 to 12 volume-%, preferably 4 to 8 volume-%.

In both embodiments the diamond grain size distribution may be unimodal, bimodal, trimodal, etc.

The binder phase comprises in solution in weight-%, Co max 95, Ni max 95 and Cr 5–45 and, in addition, W max 30, Mo max 15, Al max 2, Mn max 10, Si max 2, Cu max 10, Fe max 20, Ag max 5 and Au max 10. In a preferred embodiment, the binder phase is nickel based and comprises in solution, in weight%, Co max 30 and Mo 1–6. In another preferred embodiment, the binder phase comprises in solution, in weight-%, Co max 30–70 and Mo 1–6.

The materials according to the invention are manufactured by powder metallurgical methods known per se namely mixing, compaction and sintering in the diamond stable area.

The material according to the invention is particularly useful for machining of particle board, chip board, medium density fiber board and dry woods. For cutting of particle board, chip board and medium density fiber board the binder phase content shall be 3 to 12 volume-% and for cutting of solid woods the binder phase content shall be 5 to 20 volume-%.

The invention is additionally illustrated in connection with the following Examples which are to be considered as illustrative of the present invention. It should be understood, however, that the invention is not limited to the specific details of the Examples.

EXAMPLE 1

PCD-tools according to the invention were manufactured with a diamond composition of: 4 volume-% of diamond grain size between 1 and 3 μm, 18 volume-% of diamond grain size 4–7 μm, 71 volume-% of diamond grain size 8–12 μm. TiN was added in an amount of 1 volume-% of the total mix. The binder content was 6 volume-% with a composition of 66% Co, 25% Ni, 9% Cr. The powder mixture was milled in a ball mill with ethanol and cemented carbide milling balls for four hours. The milled powder was dried in a rotating vessel and granulated in a 200 mesh size sieve. The precompaction of the powder was performed onto a disc of a straight grade cemented carbide (6% Co). The sintering was conducted under such temperature and pressure conditions where the diamonds are stable. The PCD-s were cut out by laser cutting into a conventional rectangular cutter shape with a cutting angle of 65° and ground to final shape.

EXAMPLE 2

A PCD-tool according to prior art was tested against a PCD according to the invention, example 1. The test was performed on a turning test on medium density fiber board discs.

| | |
|---|---|
| Rotating speed | 550 rpm |
| Cutting depth | 0.13 mm |

The rake and clearance angles were 15 and 10 degrees, respectively.

Three samples of each tool material were tested.

The edge radius for all tools was 2 μm.

The edge wear and the surface finish of the chip board were measured after each sample cut, a total of fifteen, 19 mm discs for a total length of cut of approximately 6883 m. The following result was obtained expressed as parallel, $F_p$, and normal, $F_n$, tool force components, in Newton, as a function of sample cut in number of discs.

| | Number of discs | | | |
|---|---|---|---|---|
| | 0 | 5 | 10 | 15 |
| According to the invention | | | | |
| $F_n$ (in Newton) | 46.7 | 51.2 | 53.4 | 55.6 |
| $F_p$ | 89.0 | 95.6 | 100.1 | 104.5 |
| According to the invention | | | | |
| $F_n$ | 47.6 | 57.8 | 62.3 | 71.2 |
| $F_p$ | 93.4 | 97.9 | 106.8 | 113.4 |

The tool of the material according to the invention gave a better smoothness of the surface in comparison with the prior art tool.

The invention has been described with reference to PCD tools but it is obvious that it can be applied also to tools with PcBN.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

I claim:

1. Tool for cutting wood comprising hard particles consisting essentially of polycrystalline diamond or polycrystalline boron nitride and 3 to 20 vol-% of a binder phase based on Ni and/or Co wherein said binder phase comprises at most 95 weight-% Co, at most 95 weight-% Ni, 5 to 45 weight-% Cr and 5 to 40 vol-% of the binder phase of nitrides and/or carbonitrides of Zr, Ti, Cr, Ta and/or V with the mean grain size of said nitrides and/or carbonitrides being less than 5 μm and said nitrides and/or carbonitrides being evenly distributed in the binder phase, the mean grain size of the diamond or polycrystalline boron nitride being between 5 and 20 um.

2. The tool of claim 1 wherein said binder phase further comprises at most 30 weight-% W and at most 15 weight-% Mo.

3. The tool of claim 1 wherein said binder phase further comprises at most 30 weight-% Co and from 1 to 6 weight-% Mo.

4. The tool of claim 1 wherein said binder phase further comprises 30–70 weight-% Co and from 1 to 6 weight-% Mo.

5. The tool of claim 1 wherein said binder phase further comprises at most 2 weight-% Al, at most 10 weight-% Mn, at most 2 weight-% Si, at most 10 weight-% Cu, at most 20 weight-% Fe, at most 5 weight-% Ag and at most 10 weight-% Au.

6. In the cutting of solid dried wood with a tool, the improvement comprising using the tool of claim 1 with a binder phase content of 5–20 % by volume.

7. In the cutting of solid dried wood with a tool, the improvement comprising using the tool of claim 1 with a binder phase content of 3–12 vol-%.

8. The tool of claim 1 wherein the nitrides and/or carbonitrides have a mean grain size of 0.3 to 4 μm.

9. The tool of claim 1 wherein the binder content is from 5 to 20 volume %.

10. The tool of claim 9 wherein the binder content is from 6 to 11 volume %.

11. The tool if claim 1 wherein the binder content is from 3 to 12 volume %.

12. The tool of claim 1 wherein the mean grain size of the diamond or boron nitride is from 5 to 8 μm.

13. The tool of claim 12 wherein the binder content is from 4 to 8 volume %.

* * * * *